US006992444B2

(12) United States Patent
Hashikawa et al.

(10) Patent No.: US 6,992,444 B2
(45) Date of Patent: Jan. 31, 2006

(54) PLASMA DISPLAY PANEL INCLUDING PARTITION WALL MEMBER

(75) Inventors: Hirokazu Hashikawa, Yamanashi-ken (JP); Takahiro Togashi, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/836,282

(22) Filed: May 3, 2004

(65) Prior Publication Data

US 2004/0227464 A1 Nov. 18, 2004

(30) Foreign Application Priority Data

May 15, 2003 (JP) ..... 2003-137270

(51) Int. Cl.
*H01J 17/49* (2006.01)

(52) U.S. Cl. ..... 313/587; 313/586

(58) Field of Classification Search ..... 313/582–587
See application file for complete search history.

(56) References Cited

U.S. PATENT DOCUMENTS 6,043,605 A * 3/2000 Park ..... 313/586
6,169,363 B1 * 1/2001 Mori et al. ..... 313/582
6,566,812 B1 * 5/2003 Torisaki et al. ..... 313/586
6,674,238 B2 * 1/2004 Otani et al. ..... 313/587
6,777,873 B2 * 8/2004 Hashikawa ..... 313/582
2003/0011307 A1 * 1/2003 Otani et al. ..... 313/582
2003/0090443 A1 * 5/2003 Kobayashi ..... 313/586
2004/0189199 A1 * 9/2004 Komaki et al. ..... 313/582
2004/0222742 A1 * 11/2004 Hashikawa et al. ..... 313/582

FOREIGN PATENT DOCUMENTS

JP 10-321145 12/1998

* cited by examiner

*Primary Examiner*—Joseph Williams
*Assistant Examiner*—Peter Macchiarolo
(74) *Attorney, Agent, or Firm*—McGinn IP Law Group, PLLC

(57) ABSTRACT

In the PDP, a discharge cell is formed in the vicinity of an intersection of a row electrode pair and a column electrode. The column electrode is formed in a different plane within a dielectric layer from that in which the row electrode pair is formed. Each of the discharge cells is surrounded and defined by a partition wall member, and divided by a second transverse wall into a display discharge cell for producing a sustain discharge and an addressing discharge cell for producing a reset discharge and an addressing discharge. The display discharge cell and the addressing discharge cell communicate by means of a clearance.

22 Claims, 10 Drawing Sheets

SECTION V1-V1

*FIRST EMBODIMENT*

SECTION V1-V1

SECTION V2-V2

SECTION W1-W1

SECTION W2-W2

SECOND EMBODIMENT

SECTION V3-V3

SECTION V4-V4

SECTION W3-W3

SECTION W4-W4

THIRD EMBODIMENT

SECTION V5-V5

SECTION V6-V6

SECTION W5-W5

SECTION W6-W6

PLASMA DISPLAY PANEL INCLUDING PARTITION WALL MEMBER

BACKGROUND OF THE INVENTION

1. Field of the Invention

This invention relates to a panel structure for surface-discharge-type AC plasma display panels.

The present application claims priority from Japanese Application No. 2003-137270, the disclosure of which is incorporated herein by reference.

2. Description of the Related Art

Surface-discharge-type AC plasma display panels (hereinafter referred to as "PDP") have recently gained the spotlight as types of large-sized slim color display apparatuses and are becoming increasingly common in homes and the like.

Such known surface-discharge-type AC PDP includes a three-electrode reflection-type PDP.

The structure of the three-electrode reflection-type PDP is described here. The front glass substrate is placed opposite the back glass substrate with a discharge-gas-filled discharge space in between. On the inner surface of the front glass substrate, a plurality of row electrode pairs and a dielectric layer overlying the row electrode pairs are provided. Each of the row electrode pairs is constituted of paired row electrodes (discharge sustaining electrodes) extending in the row direction and arranged parallel to another row electrode pair to form a display line. On the inner surface of the back glass substrate, a plurality of column electrodes (addressing electrodes) extends in the column direction. Discharge cells (unit light emission areas) are provided at each of the intersections of the column electrode and the row electrode pair in the discharge space. Further red-, green-, and blue-colored phosphor layers are provided individually in each discharge cell.

For the generation of an image on the three-electrode reflection-type PDP, first, an addressing discharge is caused selectively between the column electrode and one row electrode in the row electrode pair to generate a wall charge on the dielectric layer overlying the row electrode pairs or alternatively to erase the wall charge accumulated thereon. As a result, the discharge cells having the wall charge generated on the dielectric layer (lighted cells) and the discharge cells having no wall charge (non-lighted cells) a redistributed over the panel surface in accordance with the received image signal. After that, in each lighted cell, a sustain discharge is produced between the row electrodes in each row electrode pair. By means of this sustain discharge, vacuum ultraviolet light is emitted from xenon included in the discharge gas, and excites each of the red-, green- and blue-colored phosphor layers formed in the individual lighted cells to emit visible light for the generation of the image in a matrix display.

The conventional three-electrode reflection type PDP as structured in this manner is described in Japanese Patent Laid-open Application No. 10-321145.

The conventional structure of the three-electrode reflection-type PDP as described above requires a complicated manufacturing process for forming the electrodes separately on the front glass substrate and the back glass substrate, and a high degree of accuracy of the positional relationship of the electrodes between the front glass substrate and the back glass substrate. Therefore, this conventional PDP has the problem of the entailing high manufacturing costs and a further increase in costs due to the large number of components formed on each substrate.

On this account, a PDP having the row electrodes and the column electrodes both formed on a single glass substrate has been proposed for the achievement of cost cutting and of a finer resolution of the image display.

In the proposed PDP, a glass substrate placed opposite another glass substrate having a phosphor layer formed thereon has the double-layer structure of the row electrode pairs and the column electrodes which extend in a direction at right angles to the row electrode pairs being formed with the dielectric layer in between.

FIG. 1 is a front view showing the structure of a conventional PDP having the row electrode pairs and the column electrodes both formed on a single substrate.

In FIG. 1, on the inner surface of one of the substrates (not shown) of the PDP, row electrode pairs (X, Y) each constituted of the paired row electrodes X and Y extend in the row direction and are regularly arranged in plurality in the column direction. The row electrode pairs (X, Y) are covered with a first dielectric layer (not shown). On the inner surface of the first dielectric layer, bodies Da of a plurality of column electrodes D extend in the column direction and are arranged at regular intervals in the row direction. The bodies Da of the column electrodes D are covered with a second dielectric layer (not shown).

Each of the column electrodes D has discharge portions Db formed in the first dielectric layer, so that each of the discharge portions Db is flush with and opposite the row electrode X or Y of the row electrode pair (X, Y) to cause an addressing discharge in association therewith.

Discharge cells C are formed in each position opposite the area surrounded by the paired row electrodes X and Y and the two bodies Da of the adjacent column electrodes D, inside a discharge space defined between the two substrates.

Each of the row electrode pairs (X, Y) forms a display line L.

The foregoing surface-discharge-type AC PDP generates images as follows.

In a reset period, a reset discharge is produced simultaneously in each discharge cell C between one row electrode in the row electrode pair (X, Y) (in this case, the row electrode Y) and the discharge portion Db of the column electrode D. Then in the subsequent addressing period, an addressing discharge is produced selectively in the discharge cells C between the row electrode Y and the discharge portion Db of the column electrode D, whereby the lighted cells (the discharge cells C having wall charges generated on the dielectric layer) and the non-lighted cells (the discharge cells C having no wall charges generated on the dielectric layer) are distributed over the panel surface in accordance with the image to be displayed.

After the completion of the addressing period, a discharge-sustaining pulse is alternately applied, simultaneously in all the display lines L, to the row electrodes X and Yin each row electrode pair. Thereupon, due to the wall charges accumulated on the dielectric layer, a sustain discharge is produced between the row electrodes X and Y in each lighted cell with every application of the discharge-sustaining pulse.

As a result of the sustain discharge, ultraviolet light is generated from the discharge gas in each light cell, and excites each of the red (R), green (G) and blue (B) colored phosphor layers formed in the individual discharge cells C, to emit visible light for the generation of the images.

The conventional surface-discharge-type AC PDP structured as described hitherto has the following problems.

The reset discharge, the addressing discharge and the sustain discharge are all produced in the same discharge cell.

Under these circumstances, the reset discharge and the addressing discharge excite the red (R), green (G) and blue (B) phosphor layers and therefore light emission from the phosphor is repeated. This light emission raises the brightness level when the display is black, which is a factor that lowers the light-dark contrast.

Further, the sustain discharge for visible light emission must be produced in the same discharge cell as that in which the reset discharge and addressing discharge preparatory to the light emission are produced. When the cell structure is designed, the necessity for compatibility between those discharges gives rise to considerable restrictions. This involves the problem of difficulties arising in providing the adequate discharge characteristics in any discharge.

In addition, in the conventional PDP, the addressing discharge produced in the same discharge cell C as that in which the sustain discharge is produced is affected by: the discharge characteristics varying among the individual phosphor materials of the colors of the phosphor layers formed in the respective discharge cells C; the change in discharge voltage traceable to the phosphor layers, for example, that is caused by variations in the layer thickness of the phosphor layers occurring when the phosphor layers are formed in the manufacturing process; and the like. For this reason, the conventional PDP has the problem of significant difficulties arising in providing equal addressing discharge characteristics in all the discharge cells C.

SUMMARY OF THE INVENTION

The present invention is essentially designed to solve the problems associated with the conventional surface-discharge-type AC plasma display panels as described hitherto.

It is, therefore, an object of the present invention to provide a plasma display panel having row electrode pairs and column electrodes formed on a single substrate, and capable of making the addressing discharge characteristics in all discharge cells uniform and improving the dark-light contrast.

To achieve this object, the plasma display panel according to the present invention comprises: a pair of substrates opposite each other with a discharge space in between; a plurality of row electrode pairs extending in a row direction and regularly arranged in a column direction on the rear-facing face of one substrate in the pair of substrates to respectively form display lines; a dielectric layer overlying the row electrode pairs; a plurality of column electrodes extending in the column direction and regularly arranged in the row direction within the dielectric layer, and formed in a different plane from that in which the row electrode pairs are formed within the dielectric layer; unit light-emission areas individually formed in the discharge space in the proximity of intersections of the row electrode pairs and the column electrodes; a partition wall member provided for individually surrounding and defining each of the unit light emission areas; and a dividing wall provided for further partitioning each of the unit light emission areas so defined into a first discharge area and a second discharge area. The first discharge area faces mutually opposing portions of the respective row electrodes constituting each row electrode pair and is provided for producing a discharge between the row electrodes concerned. The second discharge area faces a portion of each of the column electrodes opposing a portion of one row electrode in each row electrode pair and is provided for producing a discharge between the portion of the column electrode and the portion of the row electrode. The plasma display panel also comprises communicating elements each provided between the first discharge area and the second discharge area for communication from the second discharge area to the first discharge area.

In this plasma display panel, for the generation of an image, a reset discharge is caused, in each second discharge area facing the portion of the column electrode, between the portion of the column electrode and the portion of the row electrode in the row electrode pair formed on the same substrate as the column electrode is formed on. This reset discharge triggers the generation/erasure of a wall charge on/from the dielectric layer facing the first discharge area by way of the communicating element provided between the second discharge area and the first discharge area.

Next, an addressing discharge generated selectively between the portion of the column electrode and the portion of the row electrode in the row electrode pair is produced in the second discharge area facing the portion of the column electrode. Charged particles generated in the second discharge area by means of the addressing discharge flow into the first discharge area through the communicating element. Thus, the first discharge areas having a wall charge (lighted cells) and the first discharge areas having no wall charge (non-lighted cells) are distributed over the panel surface in accordance with the image to be generated.

Then, in each of the first discharge area having a wall charge (i.e. in each of the lighted cells), a sustain discharge for light emission for the generation of the image is produced between the mutually facing portions of the row electrodes constituting the row electrode pair.

With the foregoing plasma display panel, because the row electrode pairs and the column electrodes are formed on one of the pair of substrates facing each other with the discharge space in between, it is possible to simplify the manufacturing process to substantially reduce the manufacturing costs.

Because the reset discharge and the addressing discharge are caused in the second discharge area which is formed independently of the first discharge area which is provided for producing the sustain discharge for light emission for the generation of the image, it is possible to employ a configuration capable of preventing the emissions caused by the reset discharge and the addressing discharge from leaking toward the display screen of the panel for the prevention of a reduction in the dark-light contrast of the image.

Further, there is no need to provide a phosphor layer in the second discharge area in which the addressing discharge is produced. This makes it possible to avoid the effects of the phosphor layer on: the discharge characteristics varying among the individual phosphor materials of the colors of the phosphor layers; a change in discharge voltage caused by the phosphor layer, for example, caused by variations in the thickness of the phosphor layer occurring when the phosphor layer is formed in the manufacturing process; and the like. This ensures the uniformity of the addressing discharge characteristics in each second discharge area, to improve a margin in the addressing discharge.

Still further, the first discharge area is only required to produce the sustain discharge. For this reason, the limitations imposed on the structure of the first discharge area are decreased, resulting in the possibility of optimizing the structure of the first discharge area for the sustain discharge.

These and other objects and features of the present invention will become more apparent from the following detailed description with reference to the accompanying drawings.

DETAILED DESCRIPTION OF THE PREFERRED EMBODIMENTS

Preferred embodiments according to the present invention will be described below in detail with reference to the accompanying drawings.

Figure 1:
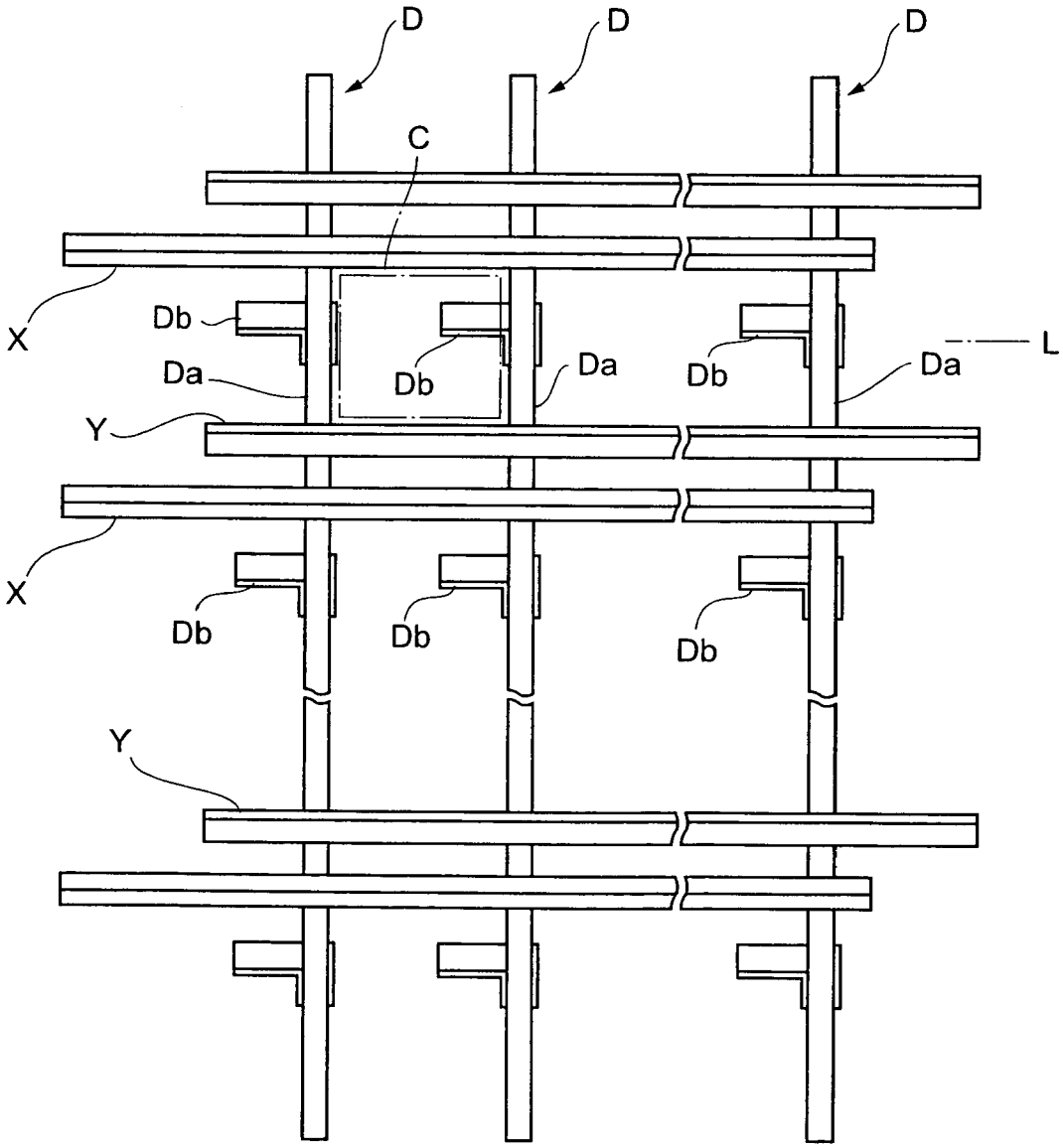
Fig.1 PRIOR ART
FIG. 1 is a front view of the structure of a conventional PDP.
Figure 2:
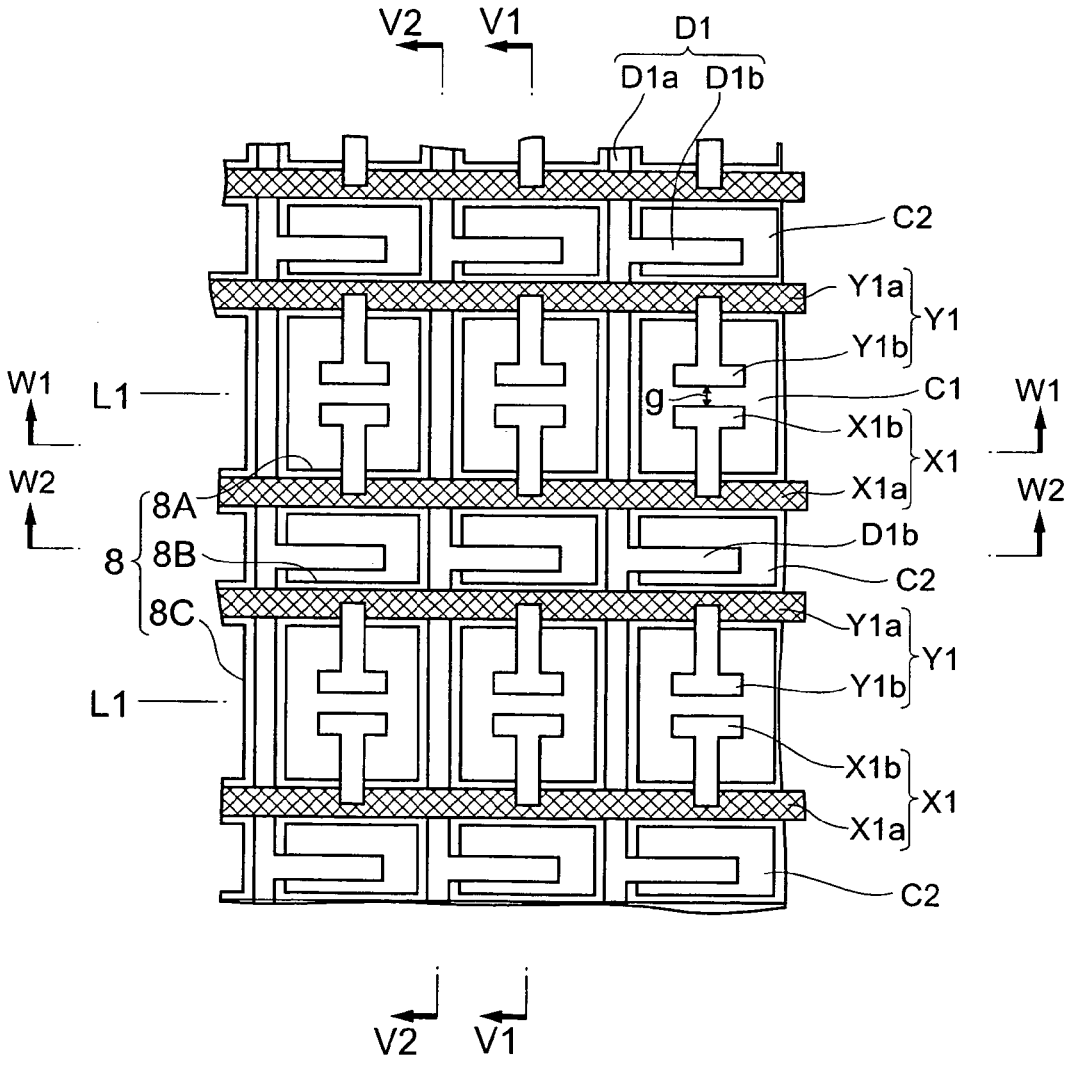
FIG. 2 is a schematic front view illustrating a first embodiment according to the present invention.
Figure 3:
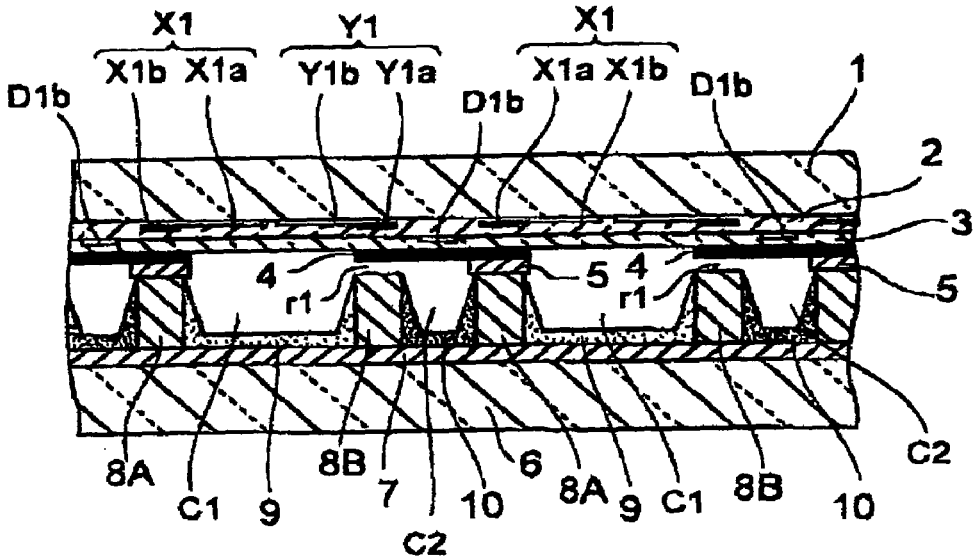
FIG. 3 is a sectional view taken along the V1—V1 line in FIG. 2.
Figure 4:
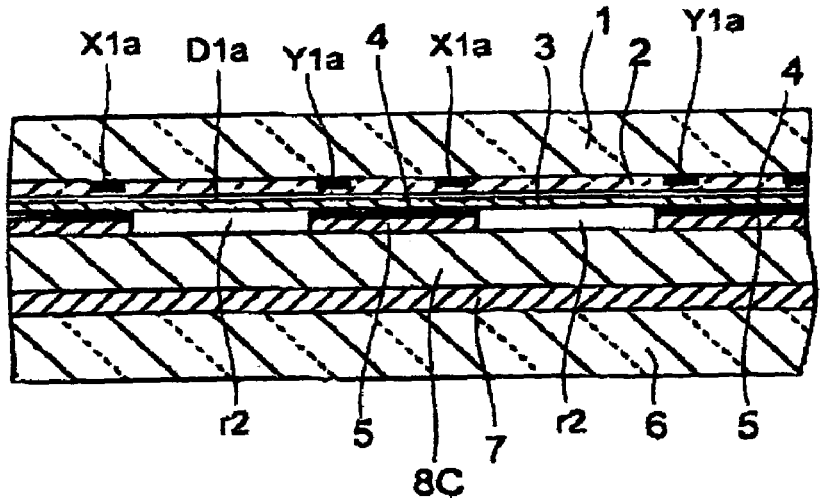
FIG. 4 is a sectional view taken along the V2—V2 line in FIG. 2.
Figure 5:
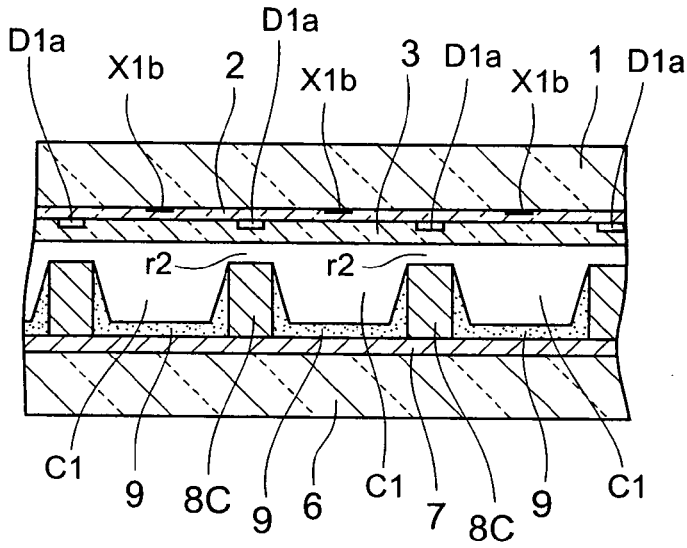
FIG. 5 is a sectional view taken along the W1—W1 line in FIG. 2.
Figure 6:
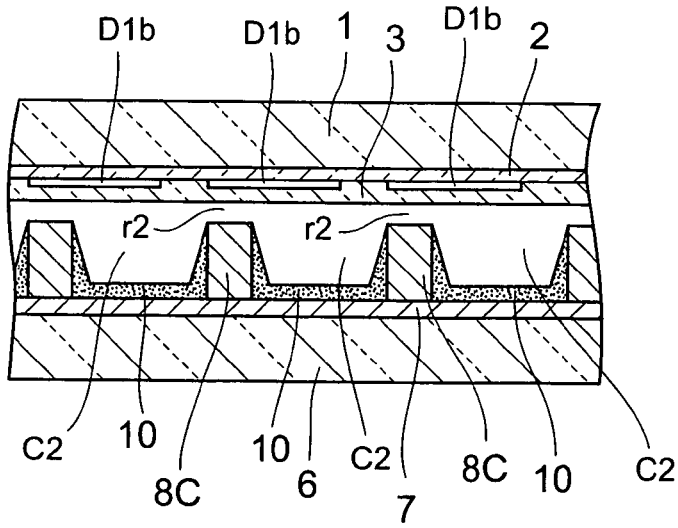
FIG. 6 is a sectional view taken along the W2—W2 line in FIG. 2.

FIG. 2 to FIG. 6 are diagrams illustrating a first embodiment of a plasma display panel (hereinafter referred to as "PDP") according to the present invention: FIG. 2 is a schematic front view of the PDP and FIGS. 3, 4, 5 and 6 are sectional views respectively taken along the V1—V1 line, the V2—V2 line, the W1—W1 line and the W2—W2 line as shown in FIG. 2.

In FIG. 2 to FIG. 6, a plurality of row electrode pairs (X1, Y1) each extending in the row direction of a front glass substrate 1 (i.e. the right-left direction in FIG. 2) are arranged parallel to each other on the rear-facing face of the front glass substrate 1 serving as the display screen.

The row electrode X1 is composed of a black- or dark-colored bus electrode X1*a* formed of a metal film extending in the row direction of the front glass substrate 1, and T-shaped transparent electrodes X1*b* formed of a transparent conductive film made of ITO or the like. The transparent electrodes X1*b* are lined up along the bus electrode X1*a* at regular intervals, and connected to the bus electrode X1*a* at the proximal ends (corresponding to the foot of the T shape) of thereof.

Likewise, the row electrode Y1 is composed of a black- or dark-colored bus electrode Y1*a* formed of a metal film extending in the row direction of the front glass substrate 1, and T-shaped transparent electrodes Y1*b* formed of a transparent conductive film made of ITO or the like. The transparent electrodes Y1*b* are lined up along the bus electrode Y1*a* at regular intervals, and connected to the bus electrode Y1*a* at the proximal ends (corresponding to the foot of the T shape) of thereof.

The row electrodes X1 and Y1 are arranged in alternate positions in the column direction of the front glass substrate 1 (i.e. the vertical direction in FIG. 2). The transparent electrodes X1*b* and Y1*b* which are lined up along the corresponding bus electrodes X1*a* and Y1*a* in each row electrode pair at regular intervals extend in the direction toward its counterpart in the row electrode pair, such that the two distal widened-ends (corresponding to the head of the T shape) of the transparent electrodes X1*b* and Y1*b* face each other with a discharge gap g having a required width in between.

Each of the row electrode pairs (X1, Y1) forms a display line L1 of the panel. A required spacing, described later, is provided between the row electrodes X1 and Y1 positioned back to back in between the adjacent display lines L.

A first dielectric layer 2 is provided on the rear-facing face of the front glass substrate 1 so as to cover the row electrode pairs (X1, Y1).

On the rear-facing face of the first dielectric layer 2, strip-shaped column-electrode bodies D1*a* each forming part of a column electrode D1 each extend in a direction at right angles to the bus electrodes X1*a*, Y1*a* (i.e. the column direction) and are arranged parallel to each other at regular intervals. Each of the column-electrode bodies D1*a* is positioned opposite to a strip extending through mid-positions between the transparent electrodes X1*b*, Y1*b* which are regularly spaced in the row direction along the corresponding bus electrodes X1*a*, Y1*a* of the row electrodes X1, Y1.

On the rear-facing face of the first dielectric layer 2, further, bar-shaped column-electrode projections D1*b* forming part of the column electrode D1 are formed integrally with each of the column-electrode bodies D1*a*, and each extend from a long side of the column-electrode body D1*a* in the row direction such that the leading end thereof is positioned opposite a mid-position of the spacing between the row electrodes X1 and Y1 which are positioned back to back in between the adjacent display lines L.

A second dielectric layer 3 is formed on the rear-facing face of the first dielectric layer 2 so as to cover the column-electrode bodies D1*a* and the column-electrode projections D1*b* of the column electrodes D1.

Strip-shaped first additional dielectric layers 4 project from the rear-facing face of the second dielectric layer 3. Each of the additional dielectric layers 4 extends in the row direction along the bus electrodes X1*a*, Y1*a* positioned back to back in between the adjacent display lines L, in a position opposite to the back-to-back bus electrodes X1*a* and Y1*a* and the area between the bus electrodes X1*a* and Y1*a* concerned.

The first additional dielectric layer 4 is constituted of a light absorption layer including a black- or dark-colored pigment.

A second additional dielectric layer 5 projects from the rear-facing face of each of the first additional dielectric layers 4, and extends parallel to the bus electrode Y1*a* and the column-electrode body D1*a* in the portion of the rear-facing face of the first additional dielectric layer 4 opposite to the bus electrode X1*a* and to a portion of the column-electrode body D1*a* between the bus electrodes X1*a* and Y1*a* which are positioned back to back in between the adjacent display lines L1.

Further, an MgO made protective layer (not shown) is formed on the rear-facing faces of the second dielectric layer 3, the first additional dielectric layers 4 and the second additional dielectric layers 5.

The front glass substrate 1 is opposite to a back glass substrate 6 with a discharge space in between. A protective layer (dielectric layer) 7 is formed on the front-facing face (inner face) of the back glass substrate 6. On the protective layer 7, a partition wall member 8 is formed in a form as follows.

When viewed from the front glass substrate 1, the partition wall member 8 is composed of first transverse walls 8A, second transverse walls 8B and vertical walls 8C. Each of the first transverse walls 8A extends opposite and parallel to the bus electrode X1*a* of each row electrode X1 in the row direction. Each of the second transverse walls 8B extends opposite and parallel to the bus electrode Y1*a* of each row electrode Y1 in the row direction. Each of the vertical walls 8C extends opposite and parallel to the column-electrode body D1*a* of each column electrode D1 in the column electrode.

The height of each of the first transverse wall 8A, second transverse wall 8B and vertical wall 8C is designed to be equal to a distance between the protective layer covering the rear-facing face of the second additional dielectric layer 5 and the protective layer 7 formed on the back glass substrate 6.

With this design, the front-facing face (the upper face in FIG. 3) of the first transverse wall 8A, and the front-facing face of the portion of the vertical wall 8C extending between the adjacent display lines L1 are in contact with the rear-facing face of the protective layer covering the second additional dielectric layer 5. The second additional dielectric layer 5 is not formed between the second transverse wall 8B and the first additional dielectric layer 4, so that a clearance r1 is formed between the front-facing face of the second transverse wall 8B and the protective layer covering the first additional dielectric layer 4 (see FIG. 3).

The first additional dielectric layer 4 and the second additional dielectric layer 5 are not similarly formed between the portion of the vertical wall 8C extending between the row electrodes X1 and Y1 of each row electrode pair (X1, Y1) and the second dielectric layer 3. Hence, a clearance r2 is formed between the front-facing face of the vertical wall 8C and the protective layer covering the second dielectric layer 3 (see FIGS. 4 to 6).

The first transverse walls 8A, second transverse walls 8B and vertical walls 8C of the partition wall member 8 partition the discharge space defined between the front and back glass substrates 1 and 6 into areas. In each of the partitioned areas, a display discharge cell C1 facing the opposed transparent electrodes X1*b* and Y1*b* paired with each other is formed. Further, the discharge space corresponding to the strip-shaped area between the first transverse wall 8A and the second transverse wall 8B and also between the back-to-back bus electrodes X1*a* and Y1*a* of the adjacent row electrode pairs (X1, Y1) is partitioned by the vertical walls 8C to form addressing discharge cells C2. As a result, the display discharge cells C1 and the addressing discharge cells C2 are arranged in alternate positions in the column direction.

The display discharge cell C1 and the addressing discharge cell C2 adjacent to each other on both sides of the second transverse wall 8B communicate by means of the clearance r1 formed between the front-facing face of the second transverse wall 8B and the protective layer covering the first additional dielectric layer 4.

In each display discharge cell C1, a phosphor layer 9 covers almost all five faces facing the discharge space, i.e. the face of the protective layer 7 and the side faces of the first transverse wall 8A, second transverse wall 8B, and vertical walls 8C of the partition wall member 8. The red (R), green (G) and blue (B) colors are individually applied to the phosphor layers 9 in such a manner so that the red, green and blue display discharge cells C1 are arranged in order in the row direction.

In each addressing discharge cell C2, a high γ material layer 10 covers almost all five faces facing the discharge space, i.e. the face of the protective layer 7 and the side faces of the first transverse wall 8A, second transverse wall 8B and vertical walls 8C of the partition wall member 8. The high γ material layer 10 is formed of a high γ material of a relative dielectric constant ∈ equal to or higher than 50 (from 50 to 250).

The high ∈ materials used for the high γ material layer 10 include $SrTiO_3$, for example.

The display discharge cells C1 and the addressing discharge cells C2 in the discharge space are filled with a xenon-including discharge gas.

The aforementioned PDP generates images as follows.

First, in a reset period, a reset pulse is applied to the row electrode Y1 and the column electrode D1 in each addressing discharge cell C2, in order to cause a reset discharge between the bus electrode Y1*a* of the row electrode Y1 and the column-electrode projection D1*b* of the column electrode D1. This reset discharge triggers the generation of a wall charge on (or alternatively the erasure of the wall charge from) the first dielectric layer 2 and the second dielectric layer 3 facing the display discharge cell C1 by way of the clearance r1.

In the subsequent addressing period, a scan pulse is sequentially applied to the row electrodes Y1, and a data pulse is applied selectively to the column electrodes D1 in accordance with the image signal.

Thereupon, in the addressing discharge cell C2, an addressing discharge is generated between the bus electrode Y1*a* of the row electrode Y1 receiving the application of the scan pulse, and the column-electrode projection D1*b* of the column electrode D1 receiving the application of the data pulse and positioned opposite the bus electrode Y1*a* concerned when viewed from the front glass substrate 1.

At this point, with the formation of the high γ material layer 10 in the addressing discharge cell C2, the addressing discharge is started at a voltage lower than that when the high γ material layer 10 is not formed.

Then, charged particles generated by the addressing discharge in the addressing discharge cell C2 flow through the clearance r1 formed between the second transverse wall 8B and the first additional dielectric layer 4 into the display discharge cell C1 paired with the addressing discharge cell C2 on both sides of the second transverse wall 8B. Thereby, the wall charges accumulated on the portion of the first dielectric layer 2 and the second dielectric layer 3 opposite the display discharge cell C1 are selectively erased therefrom (or alternatively wall charges are generated on the first dielectric layer 2 and the second dielectric layer 3). As a result, lighted cells (the display discharge cells C1 having the wall charges generated on the first dielectric layer 2 and the second dielectric layer 3) and non-lighted cells (the display discharge cells C1 having no wall charges generated on the first dielectric layer 2 and the second dielectric layer 3) are distributed in all the display lines L1 in accordance with the image to be generated.

In a sustaining emission period subsequent to the addressing period, a discharge-sustaining pulse is applied, simultaneously in all the display lines L1, alternately to the row electrodes X1 and Y1 in the row electrode pair (X1, Y1) Thereupon, in each lighted cell, a sustain discharge is produced between the transparent electrodes X1*b* and Y1*b* facing each other with every application of the discharge-sustaining pulse.

As a result of the sustain discharge, ultraviolet light is generated from xenon Xe in the discharge gas and excites each of the red (R), green (G) and blue (B) phosphor layers 9 facing the individual display discharge cells C1 to allow the phosphor layers 9 to emit visible light for the generation of the image.

In the PDP in the first embodiment, by forming both the row electrode pairs (X1, Y1) and the column electrodes D1 on the front glass substrate 1, the distance between the bus electrode Y1*a* of the row electrode Y1 and the column-electrode projection D1*b* between which the addressing discharge is generated is shortened. For this reason, the addressing discharge is caused at a low discharge-starting voltage.

Further, the PDP does not requires in the manufacturing process a high degree of accuracy of the alignment between the front glass substrate 1 and the back glass substrate 6, the height of the wall partition wall member, and the like, leading to the simplification of the manufacturing process.

In the foregoing PDP, the addressing discharge cell C2 for producing the reset discharge and the addressing discharge is separated from the display discharge cell C1 for producing the sustain discharge. The black- or dark-colored first additional dielectric layer 4 is formed over the addressing discharge cell C2 on the panel screen side of the addressing discharge cell C2. For the reasons, the light generated by the reset discharge and the addressing discharge in the addressing discharge cell C2 is blocked by the first additional dielectric layer 4 to be prevented from leaking toward the front glass substrate 1.

Accordingly the panel display surface is prevented from shining every time the reset discharge and the addressing discharge which are not a discharge for emitting light for the image generation are produced. Thereby, it is possible to prevent a decrease in light-dark contrast in the image caused by the reset discharge and the addressing discharge.

Further, because a phosphor layer is not provided in the addressing discharge cell C2 in which the addressing discharge is produced, the phosphor layer has no effects on: the discharge characteristics varying among the individual phosphor materials of the colors of the phosphor layers; variations in discharge voltage caused by the phosphor layer, for example, by variations in the thickness of the phosphor layer occurring when the phosphor layer is formed in the manufacturing process; and the like. This ensures the uniformity of the addressing discharge characteristics in each addressing discharge cell C2, to improve a margin in the addressing discharge.

Still further, the display discharge cell C1 is only required to produce the sustain discharge. For this reason, the limitations imposed on the structure of the display discharge cell are eliminated, resulting in the possibility of optimizing the structure of the display discharge cell C1 for the sustain discharge.

Figure 7:
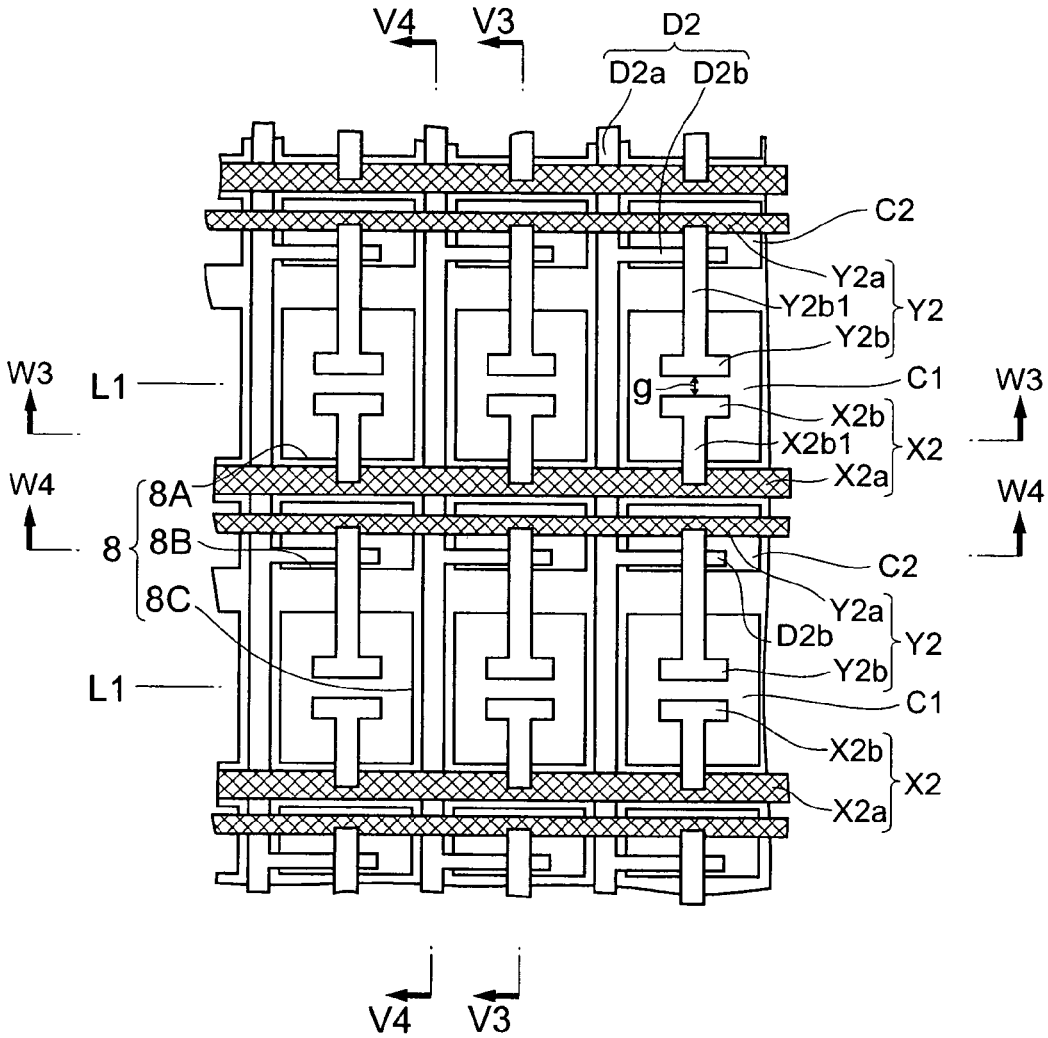
FIG. 7 is a schematic front view illustrating a second embodiment according to the present invention.

FIG. 7 to FIG. 11 are diagrams illustrating a second embodiment of the PDP according to the present invention: FIG. 7 is a schematic front view of the PDP and FIGS. 8, 9, 10 and 11 are sectional views respectively taken along the V3—V3 line, the V4—V4 line, the W3—W3 line and the W4—W4 line as shown in FIG. 7.

In FIG. 7 to FIG. 11, a plurality of row electrode pairs (X2, Y2) each extending in the row direction of a front glass substrate 1 (i.e. the right-left direction in FIG. 7) are arranged parallel to each other on the rear-facing face of the front glass substrate 1 serving as the display screen.

The row electrode X2 is composed of a bus electrode X2*a* formed of a black- or dark-colored metal film extending in the row direction of the front glass substrate 1, and T-shaped transparent electrodes X2*b* formed of a transparent conductive film made of ITO or the like. The transparent electrodes X2*b* are lined up along the bus electrode X2*a* at regular intervals, and connected to the bus electrode X2*a* at the leg portion X2*b*1 of a small width thereof.

Likewise, the row electrode Y2 is composed of a black- or dark-colored bus electrode Y2*a* formed of a metal film extending in the row direction of the front glass substrate 1, and T-shaped transparent electrodes Y2*b* formed of a transparent conductive film made of ITO or the like. The transparent electrodes Y2*b* are lined up along the bus electrode Y2*a* at regular intervals, and connected to the bus electrode Y2*a* at the leg portion Y2*b*1 of a small width thereof.

The small-width leg-portion Y2*b*1 of each of the transparent electrodes Y2*b* of the row electrode Y2 is greater in length than that of the small-width leg-portion X2*b*1 of each transparent electrode X2*b* of the row electrode X2.

The row electrodes X2 and Y2 are arranged in alternate positions in the column direction of the front glass substrate 1 (i.e. the vertical direction in FIG. 7). The transparent electrodes X2*b* and Y2*b* which are regularly spaced along the corresponding bus electrodes X2*a* and Y2*a* in each row electrode pair extend in the direction toward its counterpart in the row electrode pair, such that the two tops (of a large width) of the transparent electrodes X2*b* and Y2*b* face each other with a discharge gap g having a required width in between.

A first dielectric layer 12 is provided on the rear-facing face of the front glass substrate 1 so as to cover the row electrode pairs (X2, Y2).

On the rear-facing face of the first dielectric layer 12, strip-shaped column-electrode bodies D2*a* each forming part of a column electrode D2 each extend a direction at right angles to the bus electrodes X2*a*, Y2*a* (i.e. in the column direction) and are arranged parallel to each other at regular intervals. Each of the column-electrode bodies D2*a* is positioned opposite to a strip extending through mid-positions between the transparent electrodes X2*b*, Y2*b* which are regularly spaced in the row direction along the corresponding bus electrodes X2*a*, Y2*a* of the row electrodes X2, Y2.

On the rear-facing face of the first dielectric layer 12, further, bar-shaped column-electrode projections D2*b* forming part of the column electrode D2 are formed integrally with each of the column-electrode bodies D2*a*. Each of the column-electrode projections D2*b* extends from a long side of the column-electrode body D2*a* in the row direction along the long side of the bus electrode Y2*a* facing toward the row electrode X2 paired therewith. The leading end of the column-electrode projection D2*b* intersects the leg portion Y2*b*1 of the transparent electrode Y2*b* in the proximity of the connection portion of the bus electrode Y2*a* to the transparent electrode Y2*b* when viewed from the front substrate 1.

A second dielectric layer 13 is formed on the rear-facing face of the first dielectric layer 12 so as to cover the column-electrode bodies D2*a* and the column-electrode projections D2*b* of the column electrodes D2.

Strip-shaped first additional dielectric layers 4 project from the rear-facing face of the second dielectric layer 13. Each of the additional dielectric layer 4 extends in the row direction along the bus electrodes X2*a*, Y2*a* positioned back to back in between the adjacent display lines L1, in a position opposite to: the back-to-back bus electrodes X2*a* and Y2*a*; the column-electrode projections D2*b* extending along the bus electrode Y2*a*; and a strip area of a required width from the long side of the column-electrode projection D2*b* in the direction toward the large-width top of the transparent electrode Y2*b* intersecting the column-electrode projection D2*b* concerned.

The first additional dielectric layer 4 is constituted of a light absorption layer including a black- or dark-colored pigment.

A second additional dielectric layer 5 projects from the rear-facing face of each of the first additional dielectric layers 4. The second additional dielectric layer 5 is provided on the strip portion of the rear-facing face of the first additional dielectric layer 4 opposite the bus electrode X2*a*. Further, the second additional dielectric layer 5 is provided on the strip portion extending from one long side of the first additional dielectric layer 4 to the other long side in the column direction, that is, from a position opposite the bus electrode X2*a*, through a position opposite the bus electrode Y2*a* positioned back to back with the bus electrode X2*a* and in the adjacent display line, then through each of the column-dielectric bodies D2*a*, to the other long side of the first additional dielectric layer 4.

Further, an MgO made protective layer (not shown) is formed on the rear-facing faces of the second dielectric layer 13, the first additional dielectric layers 4 and the second additional dielectric layers 5.

The front glass substrate 1 is opposite to a back glass substrate 6 with a discharge space in between. A protective layer (dielectric layer) 7 is formed on the front-facing face (inner face) of the back glass substrate 6. On the protective layer 7, a partition wall member 8 is formed in a form as follows.

When viewed from the front glass substrate 1, the partition wall member 8 is composed of first transverse walls 8A, second transverse walls 8B and vertical walls 8C. Each of the first transverse walls 8A extends opposite and parallel to the bus electrode X2*a* of each row electrode X2 in the row direction. Each of the second transverse walls 8B extends in the row direction opposite the long side of the first additional dielectric layer 4 facing toward the large-width tops of the transparent electrodes Y2*b* of each row electrode Y2 intersecting the column electrode projections D2*b*. Each of the vertical walls 8C extends opposite and parallel to the column-electrode body D2*a* of each column electrode D2 in the column direction.

The height of each of the first transverse wall 8A, second transverse wall 8B and vertical wall 8C is designed to be equal to a distance (or length) between the protective layer covering the rear-facing face of the second additional dielectric layer 5 and the protective layer 7 formed on the back glass substrate 6.

Figure 8:
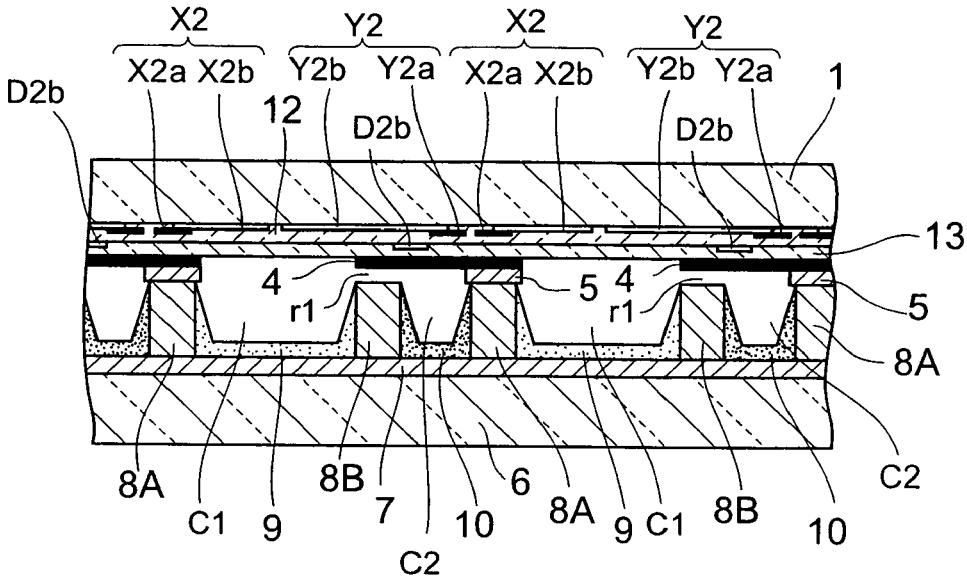
FIG. 8 is a sectional view taken along the V3—V3 line in FIG. 7.
Figure 9:
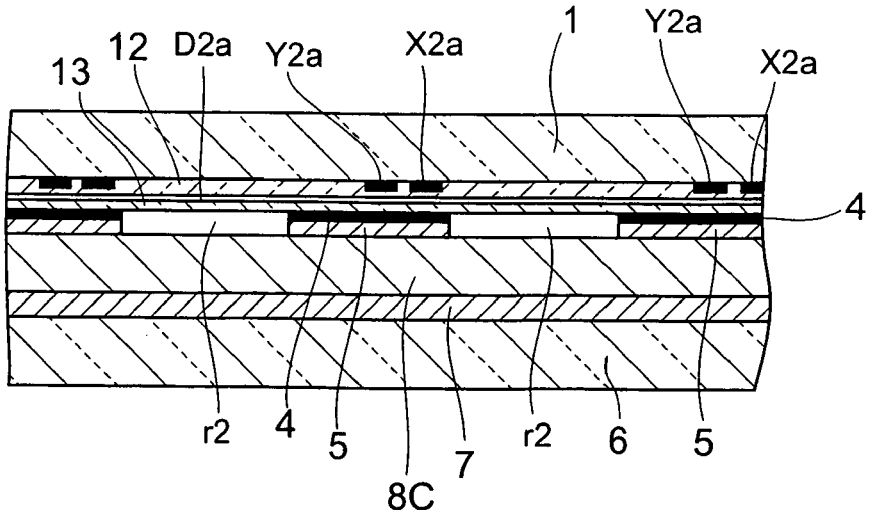
FIG. 9 is a sectional view taken along the V4—V4 line in FIG. 7.

With this design, the front-facing face (the upper face in FIG. 8) of the first transverse wall 8A, and the front-facing face of the portion of the vertical wall 8C extending from the first transverse wall 8A to the second transverse wall 8B positioned close to the bus electrode Y2*a* in the adjacent display line L1 are in contact with the rear-facing face of the protective layer covering the second additional dielectric layer 5 (see FIGS. 8 and 9). The second additional dielectric layer 5 is not formed between the second transverse wall 8B and the first additional dielectric layer 4, so that a clearance r1 is formed between the front-facing face of the second transverse wall 8B and the protective layer covering the first additional dielectric layer 4 (see FIG. 8).

The first additional dielectric layer 4 and the second additional dielectric layer 5 are not similarly formed between the second dielectric layer 13 and the portion of the vertical wall 8C extending between the second transverse wall 8B and the first transverse wall 8A positioned close to the transparent electrode X2*b* paired with the transparent electrode Y2*b* intersecting the second transverse wall 8B concerned when viewed from the front glass substrate 1.

Figure 10:
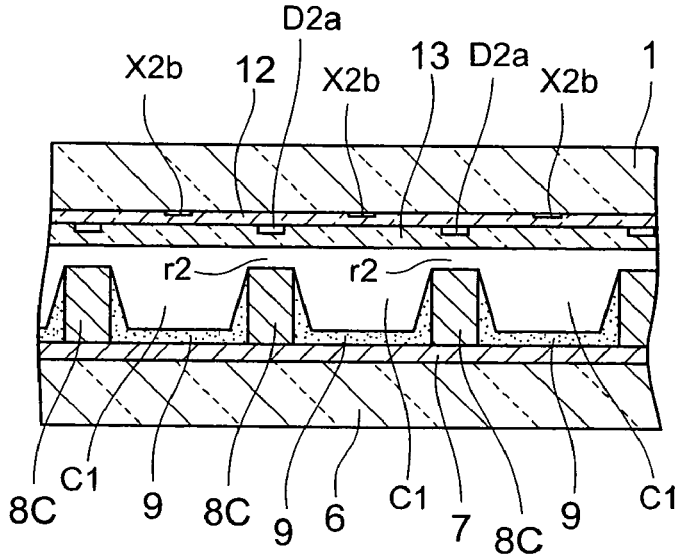
FIG. 10 is a sectional view taken along the W3—W3 line in FIG. 7.
Figure 11:
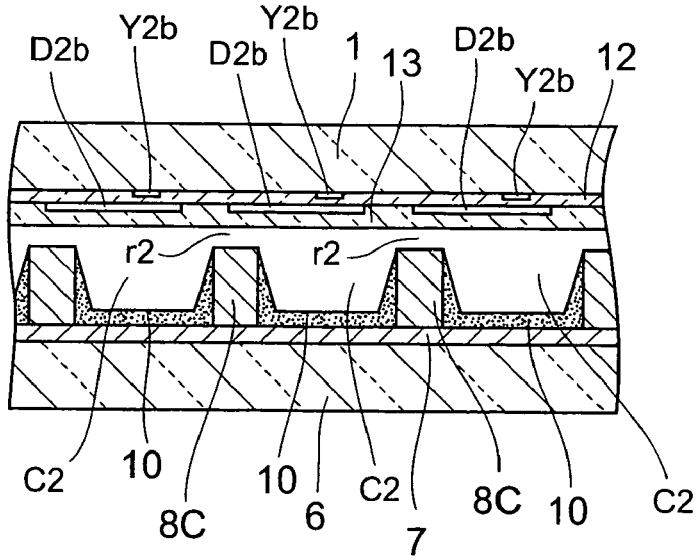
FIG. 11 is a sectional view taken along the W4—W4 line in FIG. 7.

Hence, a clearance r2 is formed between the front-facing face of the vertical wall 8C and the protective layer covering the second dielectric layer 13 (see FIGS. 9 to 11).

The first transverse walls 8A, second transverse walls 8B and vertical walls 8C of the partition wall member 8 partition the discharge space defined between the front and back glass substrates 1 and 6 into areas. In each of the partitioned areas, a display discharge cell C1 facing the opposed transparent electrodes X2*b* and Y2*b* paired with each other is formed. Further, the vertical walls 8C partitions the space corresponding to the strip-shaped area defined between the first transverse wall 8A and the second transverse wall 8B and facing the bus electrodes Y2*a* of the row electrode Y2 and the column-electrode projections D2*b* of the column electrodes D2 to from addressing discharge cells C2. As a result, the display discharge cells C1 and the addressing discharge cells C2 are arranged in alternate position in the column direction.

The display discharge cell C1 and the addressing discharge cell C2 adjacent to each other on both sides of the second transverse wall 8B in the column direction communicate by means of the clearance r1 formed between the front-facing face of the second transverse wall 8B and the protective layer covering the first additional dielectric layer 4.

In each display discharge cell C1, a phosphor layer 9 covers almost all five faces facing the discharge space, i.e. the face of the protective layer 7 and the side faces of the first transverse wall 8A, second transverse wall 8B, and vertical walls 8C of the partition wall member 8. The red (R), green (G) and blue (B) colors are individually applied to the phosphor layers 9 in such a manner so that the red, green and blue display discharge cells C1 are arranged in order in the row direction.

In each addressing discharge cell C2, a high γ material layer 10 covers almost all five faces facing the discharge space, i.e. the face of the protective layer 7 and the side faces of the first transverse wall 8A, second transverse wall 8B and vertical walls 8C of the partition wall member 8. The high γ material layer 10 is formed of a high γ material of a relative dielectric constant ∈ equal to or higher than 50 (from 50 to 250).

The high ∈ materials used for the high γ material layer 10 include $SrTiO_3$, for example.

The display discharge cells C1 and the addressing discharge cells C2 in the discharge space are filled with a xenon-including discharge gas.

The aforementioned PDP generates images as follows.

First, in a reset period, a reset pulse is applied to the row electrode Y2 and the column electrode D2 in each addressing discharge cell C2, in order to cause a reset discharge between the bus electrode Y2*a* and transparent electrode Y2*b* of the row electrode Y2 and the column-electrode body D2*a* of the column electrode D2. This reset discharge triggers the generation of a wall charge on (or alternatively the entire erasure of the wall charge from) the first dielectric layer 12 and the second dielectric layer 13 facing the display discharge cell C1 by way of the clearance r1.

In the subsequent addressing period, a scan pulse is sequentially applied to the row electrodes Y2, and a data pulse is applied selectively to the column electrodes D2 in accordance with the image signal.

Thereupon, in the addressing discharge cell C2, an addressing discharge is generated between the bus electrode Y2*a* and transparent electrode Y2*b* of the row electrode Y2 receiving the application of the scan pulse, and the column-electrode projection D2*b* of the column electrode D2 receiving the application of the data pulse, the column-electrode projection D2*b* intersecting the transparent electrode Y2*b* when viewed from the front glass substrate 1.

At this point, with the formation of the high γ material layer 10 in the addressing discharge cell C2, the addressing discharge is started at a voltage lower than that when the high γ material layer 10 is not formed.

Then, charged particles generated by the addressing discharge in the addressing discharge cell C2 flow through the clearance r1 formed between the second transverse wall 8B and the first additional dielectric layer 4 into the display discharge cell C1 paired with the addressing discharge cell C2 concerned on both sides of the second transverse wall 8B. Thereby, the wall charges accumulated on the portion of the first dielectric layer 12 and the second dielectric layer 13 opposite the display discharge cell C1 are selectively erased therefrom (or alternatively wall charges are generated on the first dielectric layer 12 and the second dielectric layer 13). As a result, lighted cells (the display discharge cells C1 having the wall charges generated on the first dielectric layer 12 and the second dielectric layer 13) and non-lighted cells (the display discharge cells C1 having no wall charges generated on the first dielectric layer 12 and the second dielectric layer 13) are distributed in all the display lines L1 in accordance with the image to be generated.

In a sustaining emission period subsequent to the addressing period, a discharge-sustaining pulse is applied, simultaneously in all the display lines L1, alternately to the row electrodes X2 and Y2 in the row electrode pair (X2, Y2). Thereupon, in each lighted cell, a sustain discharge is produced between the transparent electrodes X2*b* and Y2*b* facing each other with every application of the discharge-sustaining pulse.

As a result of the sustain discharge, ultraviolet light is generated from xenon Xe in the discharge gas and excites each of the red (R), green (G) and blue (B) phosphor layers 9 facing the individual display discharge cells C1 to allow the phosphor layers 9 to emit visible light for the generation of the image.

In the PDP in the second embodiment, as in the case of the first embodiment, by forming both the row electrode pairs (X2, Y2) and the column electrodes D2 on the front glass substrate 1, the distance between the bus electrode Y2*a* and transparent electrode Y2*b* of the row electrode Y2 and the column-electrode projection D2*b* between which the addressing discharge is generated is shortened. For this reason, the addressing discharge is caused at a low discharge-starting voltage.

The PDP in the second embodiment, when compared to the first embodiment, a discharge starting voltage of the addressing discharge is further reduced because the column-electrode projection D2*b* is formed in a position intersecting the transparent electrode Y2*b* of the row electrode Y2.

Further, the PDP does not requires in the manufacturing process a high degree of accuracy of the alignment between the front glass substrate 1 and the back glass substrate 6, the height of the wall partition wall member, and the like, leading to the simplification of the manufacturing process.

In the foregoing PDP, the addressing discharge cell C2 for producing the reset discharge and the addressing discharge is separated from the display discharge cell C1 for producing the sustain discharge. The black- or dark-colored first additional dielectric layer 4 is formed over the addressing discharge cell C2 on the panel screen side of the addressing discharge cell C2. Hence, the light generated by the reset discharge and the addressing discharge in the addressing discharge cell C2 is blocked by the first additional dielectric layer 4 to be prevented from leaking toward the front glass substrate 1.

Accordingly the panel display surface is prevented from shining every time the reset discharge and the addressing discharge which are not a discharge for emitting light for the image generation are produced. Thereby, it is possible to prevent a decrease in light-dark contrast in the image due to the reset discharge and the addressing discharge.

Further, a phosphor layer is not provided in the addressing discharge cell C2 in which the addressing discharge is produced. There is no effects of the phosphor layer on: the discharge characteristics varying among the individual phosphor materials of the colors of the phosphor layers; variations in discharge voltage caused by the phosphor layer, for example, by variations in the thickness of the phosphor layer occurring when the phosphor layer is formed in the manufacturing process; and the like. This ensures the uniformity of the addressing discharge characteristics in each addressing discharge cell C2, to improve a margin in the addressing discharge.

Still further, the display discharge cell C1 is only required to produce the sustain discharge. For this reason, the limitations imposed on the structure of the display discharge cell are eliminated, resulting in the possibility of optimizing the structure of the display discharge cell C1 for the sustain discharge.

Figure 12:
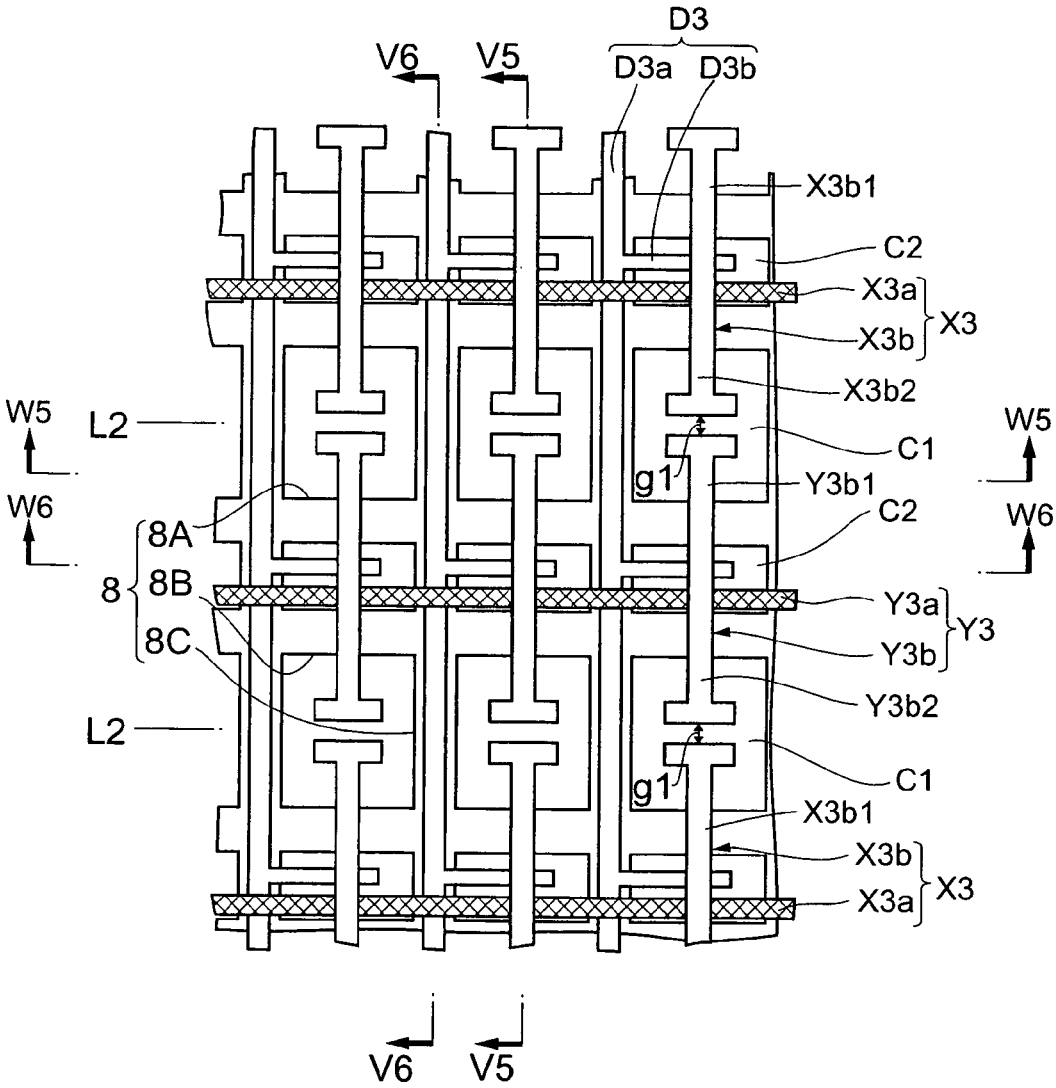
FIG. 12 is a schematic front view illustrating a third embodiment according to the present invention.

FIG. 12 to FIG. 16 are diagrams illustrating a third embodiment of the PDP according to the present invention: FIG. 12 is a schematic front view of the PDP and FIGS. 13, 14, 15 and 16 are sectional views respectively taken along the V5—V5 line, the V6—V6 line, the W5—W5 line and the W6—W6 line as shown in FIG. 12.

In FIG. 12 to FIG. 16, row electrodes X3 and row electrodes Y3 each extending in the row direction of a front glass substrate 1 (i.e. the right-left direction in FIG. 12) are regularly arranged in alternate positions at required intervals in the column direction on the rear-facing face of the front glass substrate 1 serving as the display screen.

The row electrode X3 is composed of a bus electrode X3*a* formed of a black- or dark-colored metal film extending in the row direction of the front glass substrate 1, and transparent electrodes X3*b* formed of a transparent conductive film made of ITO or the like. The transparent electrodes X3*b* are lined up along the bus electrode X3*a* at regular intervals. Each of the transparent electrodes X3*b* extends from both long sides of the bus electrode X3*a* in the column direction and is connected to the bus electrode X3*a* intersecting at right angles thereto.

Each of the transparent electrodes X3*b* is composed of a T-shaped first transparent electrode portion X3*b*1 extending from the bus electrode X3*a* upward in FIG. 12, and a T-shaped second transparent electrode portion X3*b*2 extending downward in FIG. 12.

In each transparent electrode X3*b*, the small-width leg of the first transparent electrode portion X3*b*1 is longer in length than that of the second transparent electrode portion X3*b*2.

Likewise, the row electrode Y3 is composed of a bus electrode Y3*a* formed of a black- or dark-colored metal film extending in the row direction of the front glass substrate 1, and transparent electrodes Y3*b* formed of a transparent conductive film made of ITO or the like. The transparent electrodes Y3*b* are lined up along the bus electrode Y3*a* at regular intervals. Each of the transparent electrodes Y3*b* extends from both long sides of the bus electrode Y3*a* in the column direction and is connected to the bus electrode Y3*a* intersecting at right angles thereto.

Each of the transparent electrodes Y3*b* is composed of a T-shaped first transparent electrode portion Y3*b*1 extending from the bus electrode Y3*a* upward in FIG. 12, and a T-shaped second transparent electrode portion Y3*b*2 extending downward in FIG. 12.

In each transparent electrode Y3*b*, the small-width leg of the first transparent electrode portion Y3*b*1 is longer in length than that of the second transparent electrode portion Y3*b*2.

Regarding the row electrodes X3 and Y3, the top (of a large width) of the second transparent electrode portion X3*b*2 and the top (of a large width) of the first transparent electrode portion Y3*b*1 are positioned opposite to each other as a pair with a discharge gap g1 in between. Likewise, the large-width top of the first transparent electrode portion X3*b*1 and the large-width top of the second transparent electrode portion Y3*b*2 are positioned opposite to each other as a pair with a discharge gap g1 in between.

A row of the second transparent electrode portions X3*b*2 and the first transparent electrode portions Y3*b*1 facing each other as a pair forms each display line L2, and similarly a row of the first transparent electrode portions X3*b*1 and the second transparent electrode portions Y3*b*2 facing each other as a pair forms each display line L2.

A first dielectric layer 22 is provided on the rear-facing face of the front glass substrate 1 so as to cover the row electrode X3 and Y3.

On the rear-facing face of the first dielectric layer 22, strip-shaped column-electrode bodies D3*a* each forming part of a column electrode D3 each extend a direction at right angles to the bus electrodes X3*a*, Y3*a* (i.e. in the column direction) and are arranged parallel to each other at regular intervals. Each of the column-electrode bodies D3*a* is positioned opposite to a strip extending through mid-positions between the transparent electrodes X3*b*, Y3*b* which are regularly spaced in the row direction along the corresponding bus electrodes X3*a*, Y3*a* of the row electrodes X3, Y3.

When viewed from the front glass substrate 1, each of the column electrodes D3 has further bar-shaped column-electrode projections D3*b* formed integrally with the column-electrode body D3*a*. Each of the column-electrode projections D3*b* extends from a long side of the column-electrode body D3*a* in the row direction along and in the proximity of the upper long side (in FIG. 12) of each of the bus electrodes X3*a* and Y3*a*.

The leading end of the column-electrode projection D3*b* is positioned to intersect the first transparent electrode portion X3*b*1 in the proximity of the connection portion of the bus electrode X3*a* to the leg of the first transparent electrode portion X3*b*1 of the transparent electrode X3*b*, or to intersect the first transparent electrode portion Y3*b*1 in the proximity of the connection portion of the bus electrode Y3*a* to the leg of the first transparent electrode portion Y3*b*1 of the transparent electrode Y3*b*.

A second dielectric layer 23 is formed on the rear-facing face of the first dielectric layer 22 so as to cover the column-electrode bodies D3*a* and the column-electrode projections D3*b* of the column electrodes D3.

Strip-shaped first additional dielectric layers 24 extend in the row direction along the bus electrodes X3*a*, Y3*a* and project from the rear-facing face of the second dielectric layer 23. The additional dielectric layer 24 is opposite to a strip area of a width ranging from a point at a required distance from the intersection between the first transparent electrode portion X3*b*1 of the transparent electrode X3*b* and the column-electrode projection D3*b* toward the top of the first transparent electrode portion X3*b*1, to a point at a required distance from the connection portion of the second transparent electrode portion X3*b*2 with the bus electrode X3*a* toward the top of the second transparent electrode portion X3*b*2.

The first additional dielectric layer 24 is also opposite to a strip area of a width ranging from a point at a required distance from the intersection between the first transparent electrode portion Y3*b*1 of the transparent electrode Y3*b* and the column-electrode projection D3*b* toward the top of the first transparent electrode portion Y3*b*1, to a point at a required distance from the connection portion of the second transparent electrode portion Y3*b*2 with the bus electrode Y3*a* toward the top of the second transparent electrode portion Y3*b*2.

The first additional dielectric layer 24 is constituted of a light absorption layer including a black- or dark-colored pigment.

A second additional dielectric layer 25 projects from the rear-facing face of each of the first additional dielectric layers 24. The second additional dielectric layer 25 is provided on: a strip portion of the first additional dielectric layer 24 extending in the row direction opposite a strip area having a required width ranging from the intersection between the first transparent electrode portion X3*b*1 of the transparent electrode X3*b* and the column-electrode projection D3*b* to a some point positioned in the direction of the top of the first transparent electrode portion X3*b*1; and another strip portion thereof extending in the column direction opposite a portion of the column electrode body D3*a*, the portion ranging from the above strip area to a position at a required distance between a point corresponding to the connection portion of the second transparent electrode portion X3*b*2 with the bus electrode X3*a* and a some point positioned in the direction of the top of the second transparent electrode portion X3*b*2.

The second additional dielectric layer 25 is also provided on: a strip portion of the first additional dielectric layer 24 extending in the row direction opposite a strip area having a required width ranging from the intersection between the first transparent electrode portion Y3*b*1 of the transparent electrode Y3*b* and the column-electrode projection D3*b* to a some point positioned in the direction of the top of the first transparent electrode portion Y3*b*1; and a strip portion of the same extending in the column direction opposite a portion of the column electrode body D3*a*, the portion ranging from the above strip area to a position at a required distance between a point corresponding to the connection portion of the second transparent electrode portion Y3*b*2 with the bus electrode Y3*a* and a some point positioned in the direction of the top of the second transparent electrode portion Y3*b*2.

Further, an MgO made protective layer (not shown) is formed on the rear-facing faces of the second dielectric layer 23, the first additional dielectric layers 24 and the second additional dielectric layers 25.

The front glass substrate 1 is opposite to a back glass substrate 6 with a discharge space in between. A protective layer (dielectric layer) 7 is formed on the front-facing face (inner face) of the back glass substrate 6. On the protective layer 7, a partition wall member 8 is formed in a form as follows.

The partition wall member 8 is composed of first transverse walls 8A, second transverse walls 8B and vertical walls 8C. The first transverse wall 8A extends in the row direction opposite the strip-shaped portion of the second additional dielectric layer 25 extending in the row direction. The second transverse wall 8B extends in the row direction opposite an area having a required width and including the vicinity of the connection portion of each second transparent electrode portion X3*b*2 of the transparent electrode X3*b* with the bus electrode X3*a*. The second transverse wall 8B also extends in the row direction opposite an area having a required width and including the vicinity of the connection portion of each second transparent electrode portion Y3*b*2 of the transparent electrode Y3*b* with the bus electrode Y3*a*. The vertical wall 8C is opposite and parallel to the column-electrode body D3*a* of each column electrode D3 in the column direction.

The first transverse walls 8A, second transverse walls 8B and vertical walls 8C of the partition wall member 8 partition the discharge space defined between the front and back glass substrates 1 and 6 into areas to form display discharge cells C1 and addressing discharge cells C2 arranged in alternate positions in the column direction with the first transverse wall 8A or second transverse wall 8B being interposed between the cells C1 and C2.

The display discharge cell C1 faces the second transparent electrode portion X3*b*2 and the first transparent electrode portion Y3*b*1 which are opposite each other as a pair, and another display discharge cell C1 faces the second transparent electrode portion Y3*b*2 and the first transparent electrode portion X3*b*1 which are opposite each other as a pair.

The addressing discharge cell C2 faces the bus electrode X3*a* of the row electrode X3 and the column-electrode projection D3*b* of the column electrode D3, and another addressing discharge cell C2 faces the bus electrode Y3*a* of the row electrode Y3 and the column-electrode projection D3*b* of the column electrode D3.

The height of each of the first transverse wall 8A, second transverse wall 8B and vertical wall 8C is designed to be equal to a distance (or length) between the protective layer covering the rear-facing face of the second additional dielectric layer 25 and the protective layer 7 formed on the back glass substrate 6.

Figure 13:
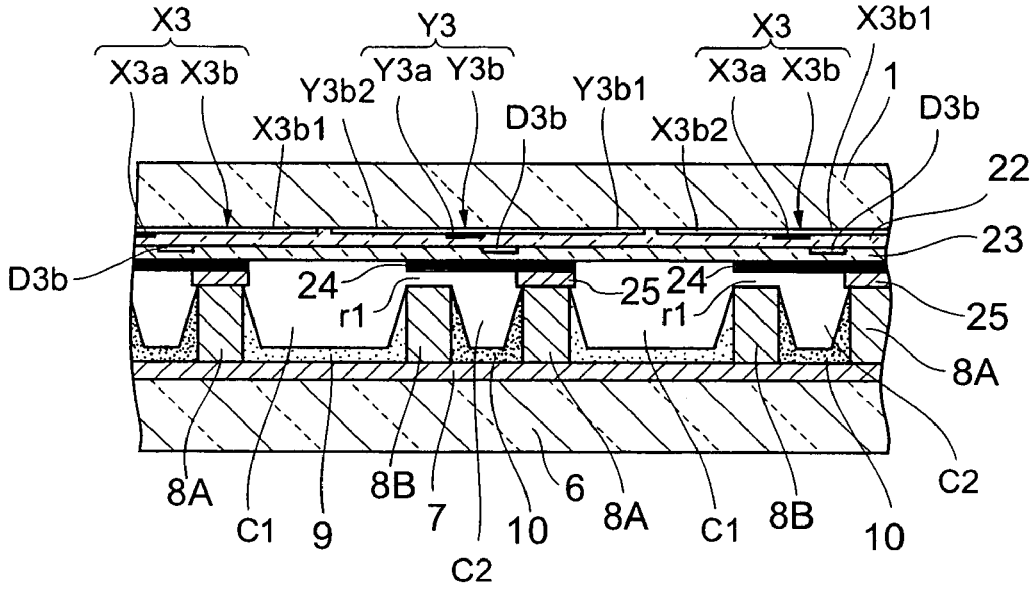
FIG. 13 is a sectional view taken along the V5—V5 line in FIG. 12.
Figure 14:
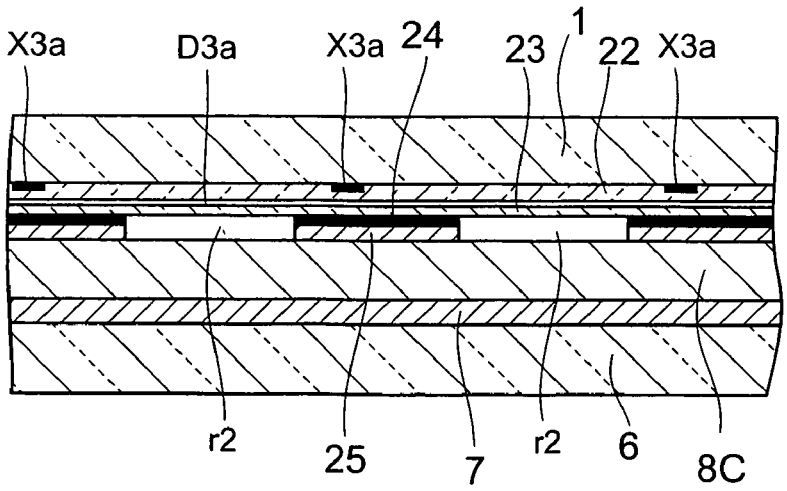
FIG. 14 is a sectional view taken along the V6—V6 line in FIG. 12.
Figure 15:
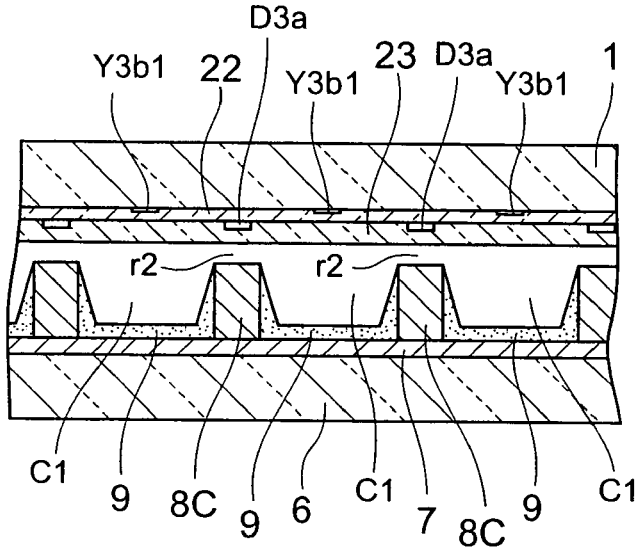
FIG. 15 is a sectional view taken along the W5—W5 line in FIG. 12.
Figure 16:
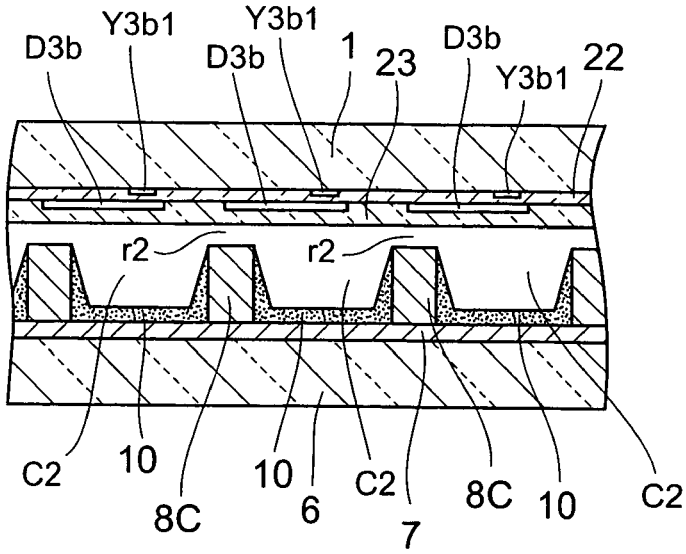
FIG. 16 is a sectional view taken along the W6—W6 line in FIG. 12.

With this design, the front-facing face (the upper face in FIG. 13) of the first transverse wall 8A and the front-facing face of the portion of the vertical wall 8C which extends from the first transverse wall 8A through the bus electrode X3*a* or bus electrode Y3*a* to the second transverse wall 8B are in contact with the rear-facing face of the protective layer covering the second additional dielectric layer 25 (see FIGS. 13 and 14). The second additional dielectric layer 25 is not formed between the second transverse wall 8B and the first additional dielectric layer 24, so that a clearance r1 is formed between the front-facing face of the second transverse wall 8B and the protective layer covering the first additional dielectric layer 24 (see FIG. 13).

The first additional dielectric layer 24 and the second additional dielectric layer 25 is not formed between the second dielectric layer 23 and the portion of the vertical wall 8C between the second transverse wall 8B and the first transverse wall 8A which are on opposite sides of the display discharge cell C1. Hence, a clearance r2 is formed between the front-facing face of the above portion of the vertical wall 8C and the protective layer covering the second dielectric layer 23 (see FIGS. 14 to 16).

The display discharge cell C1 and the addressing display cell C2 adjacent to each other on both sides of the second transverse wall 8B in the column direction communicate by means of the clearance r1.

In each display discharge cell C1, a phosphor layer 9 covers almost all five faces facing the discharge space, i.e. the face of the protective layer 7 and the side faces of the first transverse wall 8A, second transverse wall 8B, and vertical walls 8C of the partition wall member 8. The red (R), green (G) and blue (B) colors are individually applied to the phosphor layers 9 in such a manner so that the red, green and blue display discharge cells C1 are arranged in order in the row direction.

In each addressing discharge cell C2, a high γ material layer 10 covers almost all five faces facing the discharge space, i.e. the face of the protective layer 7 and the side faces of the first transverse wall 8A, second transverse wall 8B and vertical walls 8C of the partition wall member 8. The high γ material layer 10 is formed of a high γ material of a relative dielectric constant ∈ equal to or higher than 50 (from 50 to 250).

The high ∈ materials used for the high γ material layer 10 include $SrTiO_3$, for example.

The display discharge cells C1 and the addressing discharge cells C2 in the discharge space are filled with a xenon-including discharge gas.

The aforementioned PDP generates images as follows.

First, in a reset period, a reset pulse is applied to the row electrodes X3, Y3 and the column electrode D3 in each addressing discharge cell C2, in order to cause a reset discharge between the bus electrode X3*a* and first transparent electrode portion X3*b*1 and the column-electrode projection D3*b* of the column electrode D3, and a reset discharge between the bus electrode Y3*a* and first transparent electrode portion Y3*b*1 and the column-electrode projection D3*b* of the column electrode D3. This reset discharge triggers the generation of a wall charge on (or alternatively the erasure of the wall charge from) the portions of the first dielectric layer 22 and the second dielectric layer 23 facing the display discharge cell C1 by way of the clearance r1.

In the subsequent addressing period, a scan pulse is sequentially applied to the row electrodes X3 and Y3, and a data pulse is applied selectively to the column electrodes D3 in accordance with the image signal.

Thereupon, in the addressing discharge cell C2, an addressing discharge is generated between the bus electrode X3*a* and first transparent electrode portion X3*b*1 of the row electrode X3 (or the bus electrode Y3*a* and first transparent electrode portion Y3*b*1 of the row electrode Y3) receiving the application of the scan pulse, and the column-electrode projection D3*b* of the column electrode D3 receiving the application of the data pulse.

At this point, with the formation of the high γ material layer 10 in the addressing discharge cell C2, the addressing discharge is started at a voltage lower than that when the high 7 material layer 10 is not formed.

Then, charged particles generated by the addressing discharge in the addressing discharge cell C2 flow through the clearance r1 formed between the second transverse wall 8B and the first additional dielectric layer 24 into the display discharge cell C1 paired with the addressing discharge cell C2 on both sides of the second transverse wall 8B. Thereby, the wall charges accumulated on the portion of the first dielectric layer 22 and the second dielectric layer 23 opposite the display discharge cell C1 are selectively erased therefrom (or alternatively wall charges are generated on the first dielectric layer 22 and the second dielectric layer 23).

As a result, lighted cells (the display discharge cells C1 having the wall charges generated on the first dielectric layer 22 and the second dielectric layer 23) and non-lighted cells (the display discharge cells C1 having no wall charges generated on the first dielectric layer 22 and the second dielectric layer 23) are distributed in all the display lines L2 in accordance with the image to be generated.

In a sustaining emission period subsequent to the addressing period, a discharge-sustaining pulse is applied, simultaneously in all the display lines L2, alternately to the row electrodes X3 and Y3. Thereupon, in each lighted cell, a sustain discharge is produced between the first transparent electrode portion X3*b*1 and the second transparent electrode portion Y3*b*2 facing each other as a pair, or between the second transparent electrode portion X3*b*2 and the first transparent electrode portion Y3*b*1 facing each other as a pair, with every application of the discharge-sustaining pulse.

As a result of the sustain discharge, ultraviolet light is generated from xenon Xe in the discharge gas and excites each of the red (R), green (G) and blue (B) phosphor layers 9 facing the individual display discharge cells C1 to allow the phosphor layers 9 to emit visible light for the generation of the image.

In the PDP in the third embodiment, as in the case of the first embodiment, by forming both the row electrodes X3, Y3 and the column electrodes D3 on the front glass substrate 1, the distance between the column electrode D3 and the portions of the row electrodes X3 and Y3 which are used for producing the addressing discharge is generated is shortened. For this reason, the addressing discharge is caused at a low discharge-starting voltage.

The PDP in the third embodiment, when compared to the first embodiment, a discharge starting voltage of the addressing discharge is further reduced because the column-electrode projection D3*b* is formed in a position intersecting the transparent electrode X3*b* of the row electrode X3 and the transparent electrode Y3*b* of the row electrode Y3.

Further, the PDP does not requires in the manufacturing process a high degree of accuracy of the alignment between the front glass substrate 1 and the back glass substrate 6, the height of the wall partition wall member, and the like, leading to the simplification of the manufacturing process.

In the foregoing PDP, the addressing discharge cell C2 for producing the reset discharge and the addressing discharge is separated from the display discharge cell C1 for producing the sustain discharge. The black- or dark-colored first additional dielectric layer 24 is formed over the addressing discharge cell C2 on the panel screen side of the addressing discharge cell C2. Hence, the light generated by the reset discharge and the addressing discharge in the addressing discharge cell C2 is blocked by the first additional dielectric layer 24 to be prevented from leaking toward the front glass substrate 1.

Accordingly the panel display surface is prevented from shining every time the reset discharge and the addressing discharge which are not a discharge for emitting light for the image generation are produced. Thereby, it is possible to prevent a decrease in light-dark contrast in the image due to the reset discharge and the addressing discharge.

Further, a phosphor layer is not provided in the addressing discharge cell C2 in which the addressing discharge is produced. There is no effects of the phosphor layer on: the discharge characteristics varying among the individual phosphor materials of the colors of the phosphor layers; variations in discharge voltage caused by the phosphor layer, for example, by variations in the thickness of the phosphor layer occurring when the phosphor layer is formed in the manufacturing process; and the like. This ensures the uniformity of the addressing discharge characteristics in each addressing discharge cell C2, to improve a margin in the addressing discharge.

Still further, the display discharge cell C1 is only required to produce the sustain discharge. For this reason, the limitations imposed on the structure of the display discharge cell are eliminated, resulting in the possibility of optimizing the structure of the display discharge cell C1 for the sustain discharge.

In the foregoing embodiments, the high γ material layer is provided in the addressing discharge cell C2. However, instead of the high γ material layer, a secondary electron emissive layer (MgO layer) may be provided.

The formation of the secondary electron emissive layer (MgO layer) allows to ensure an adequate amount of charged particles for a supply from the addressing discharge cell C2 to the display discharge cell C1.

The first, second and third embodiments have described a PDP based on the superior idea that: substrates in a pair face each other with a discharge space in between; a plurality of row electrode pairs extend in a row direction and are regularly arranged in a column direction on the rear-facing face of one substrate in the pair of substrates to respectively form display lines; a dielectric layer overlays the row electrode pairs; a plurality of column electrodes extend in the column direction and are regularly arranged in the row direction within the dielectric layer, and formed in a different plane from that in which the row electrode pairs are formed within the dielectric layer; unit light-emission areas are individually formed in the discharge space in the proximity of intersections of the row electrode pairs and the column electrodes; a partition wall member is provided for individually surrounding and defining each of the unit light emission areas; a dividing wall is provided for further partitioning each of the unit light emission areas so defined into a first discharge area and a second discharge area, the first discharge area faces mutually opposing portions of the respective row electrodes constituting each row electrode pair and is provided for producing a discharge between the row electrodes concerned, and the second discharge area faces a portion of each of the column electrodes opposing a portion of one row electrode in each row electrode pair and is provided for producing a discharge between the portion of the column electrode and the portion of the row electrode; and communicating elements are each provided between the first discharge area and the second discharge area for communication from the second discharge area to the first discharge area.

In the PDP structure based on this superior idea, for the generation of an image, a reset discharge is caused, in each second discharge area facing the portion of the column electrode, between the portion of the column electrode and the portion of the row electrode in the row electrode pair formed on the same substrate as the column electrode is formed on.

This reset discharge triggers the generation/erasure of a wall charge on/from the dielectric layer facing the first discharge area by way of the communicating element provided between the second discharge area and the first discharge area.

Next, an addressing discharge generated selectively between the portion of the column electrode and the portion of the row electrode in the row electrode pair is produced in the second discharge area facing the portion of the column electrode. Charged particles generated in the second discharge area by means of the addressing discharge flow into the first discharge area through the communicating element. Thus, the first discharge areas having a wall charge (lighted cells) and the first discharge areas having no wall charge (non-lighted cells) are distributed over the panel surface in accordance with the image to be generated.

Then, in each of the first discharge area having a wall charge (i.e. in each of the lighted cells), a sustain discharge for light emission for the generation of the image is produced between the mutually facing portions of the row electrodes constituting the row electrode pair.

With the foregoing PDP, because the row electrode pairs and the column electrodes are formed on one of the pair of substrates facing each other with the discharge space in between, it is possible to simplify the manufacturing process to substantially reduce the manufacturing costs.

Because the reset discharge and the addressing discharge are caused in the second discharge area which is formed independently of the first discharge area which is provided for producing the sustain discharge for light emission for the generation of the image, it is possible to employ a configuration capable of preventing the emissions caused by the reset discharge and the addressing discharge from leaking toward the display screen of the panel for the prevention of a reduction in the dark-light contrast of the image.

Further, there is no need to provide a phosphor layer in the second discharge area in which the addressing discharge is produced. This makes it possible to avoid the effects of the phosphor layer on: the discharge characteristics varying among the individual phosphor materials of the colors of the phosphor layers; a change in discharge voltage caused by the phosphor layer, for example, caused by variations in the thickness of the phosphor layer occurring when the phosphor layer is formed in the manufacturing process; and the like. This ensures the uniformity of the addressing discharge characteristics in each second discharge area, to improve a margin in the addressing discharge.

Still further, the first discharge area is only required to produce the sustain discharge. For this reason, the limitations imposed on the structure of the first discharge area are decreased, resulting in the possibility of optimizing the structure of the first discharge area for the sustain discharge.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel comprising:

a pair of substrates opposite each other with a discharge space in between;

a plurality of row electrode pairs extending in a row direction and regularly arranged in a column direction on the rear-facing face of one substrate in the pair of substrates to respectively form display lines;

a dielectric layer overlaying the row electrode pairs;

a plurality of column electrodes extending in the column direction and regularly arranged in the row direction within the dielectric layer, and formed in a different plane from that in which the row electrode pairs are formed within the dielectric layer;

unit light-emission areas individually formed in the discharge space in the proximity of intersections of the row electrode pairs and the column electrodes;

a partition wall member provided for individually surrounding and defining each of the unit light emission areas;

a dividing wall provided for further partitioning each of the unit light emission areas so defined into a first discharge area facing mutually opposing portions of the row electrodes in each row electrode pair and provided for producing a discharge between the row electrodes, and a second discharge area facing a portion of each of the column electrodes opposing a portion of one row electrode in the row electrode pair and provided for producing a discharge between the portion of the column electrode and the portion of the row electrode; and communicating elements each provided between the first discharge area and the second discharge area for communication from the second discharge area to the first discharge area;

wherein said partition wall member comprises vertical walls each extending in the column direction to provide a partition between the unit light emission areas located side by side in the row direction, and transverse walls each extending in the row direction to provide a partition between the unit light emission areas located side by side in the column direction, and said dividing wall is in a form extending parallel to the transverse wall between the adjacent vertical walls.

2. A plasma display panel according to claim 1, wherein each of the column electrodes includes a column electrode body extending in the column direction, and the portion of the column electrode producing the discharge in association with the portion of the row electrode is a column electrode projection projecting from the column electrode body toward a position facing the second discharge area in each unit light emission area.

3. A plasma display panel according to claim 2, wherein the column electrode projection is in a strip-shaped form extending from the column electrode body in the row direction.

4. A plasma display panel according to claim 1, wherein each of the row electrodes constituting each row electrode pair includes a row electrode body extending in the row direction, and row-electrode projections each extending from the row electrode body toward its counterpart in the row electrodes paired with each other in each unit light emission area, and the portion of the row electrode producing the discharge in association with the portion of the column electrode is the row electrode body.

5. A plasma display panel according to claim 4, wherein the row electrode body of the row electrode not used for producing the discharge in association with the portion of the column electrode, in each row electrode pair is positioned opposite the transverse wall of the partition wall member.

6. A plasma display panel according to claim 4, wherein the row electrode body of the row electrode used for producing the discharge in association with the portion of the column electrode, in each row electrode pair is positioned opposite the dividing wall.

7. A plasma display panel according to claim 4, wherein the row electrode body of the row electrode used for producing the discharge in association with the portion of the column electrode, in each row electrode pair is arranged in a position facing the second discharge area.

8. A plasma display panel according to claim 7, wherein the portion of the column electrode intersects the row-electrode projection of the row electrode used for producing the discharge in association with the portion of the column electrode.

9. A plasma display panel according to claim 4, wherein the row electrodes positioned back to back with each other in between the adjacent display lines share use of the row electrode body.

10. A plasma display panel according to claim 9, wherein the row-electrode projections of the respective row electrodes located back to back with each other in between the adjacent display lines are continuous with each other as an extension in the column direction.

11. A plasma display panel according to claim 10, wherein the portion of the column electrode intersects the row-electrode projection of the row electrode continued from one display line to the display line adjacent thereto in the column direction.

12. A plasma display panel according to claim 9, wherein the row electrode body shared between the row electrodes located back to back in between the adjacent display lines is arranged in a position facing the second discharge area.

13. A plasma display panel according to claim 4, wherein the row electrode body of the row electrode includes a light absorption layer of either a black color or a dark color.

14. A plasma display panel according to claim 1, further comprising a light absorption layer of either a black color or a dark color provided on a portion of the one substrate facing the second discharge area.

15. A plasma display panel according to claim 14, wherein the light absorption layer is formed entirely on the portion of the one substrate facing the second discharge area.

16. A plasma display panel according to claim 14, wherein the light absorption layer is an additional member of the dielectric layer projecting from a rear-facing face of the dielectric layer toward the discharge space.

17. A plasma display panel according to claim 1, further comprising an additional member provided on a portion of the rear-facing face of the one substrate facing parts of the transverse walls and the vertical walls of the partition wall member surrounding the second discharge area, and being in contact with the parts of the transverse walls and the vertical walls of the partition wall member surrounding the second discharge area to block off the second discharge area from the first discharge area of the adjoining unit light emission area and from the second discharge areas of the adjoining unit light emission areas on either sides.

18. A plasma display panel according to claim 17, wherein the additional member is formed of a dielectric.

19. A plasma display panel according to claim 1, comprising a communicating element provided between the one substrate and a part of the vertical wall of the partition wall member interposed between the first discharge areas adjacent to each other in the row direction, and establishing communication between the adjacent first discharge areas in the row direction.

20. A plasma display panel according to claim 1, further comprising a phosphor layer emitting light by means of a discharge and provided only in the first discharge area.

21. A plasma display panel according to claim 1, further comprising a high $\epsilon$ material layer formed of a high $\epsilon$ material having a relative dielectric constant equal to or higher than a predetermined value and provided in the second discharge area.

22. A plasma display panel according to claim 21, wherein the relative dielectric constant is equal to or higher than 50.

* * * * *